US007468009B1

(12) United States Patent
Ball

(10) Patent No.: US 7,468,009 B1
(45) Date of Patent: Dec. 23, 2008

(54) BACKGROUND SHIELD FOR SOCCER PRACTICE

(76) Inventor: Alan F. Ball, 6901 Sunset Way, St. Pete Beach, FL (US) 33706

( * ) Notice: Subject to any disclaimer, the term of this patent is extended or adjusted under 35 U.S.C. 154(b) by 298 days.

(21) Appl. No.: 11/466,241

(22) Filed: Aug. 22, 2006

(51) Int. Cl.
*A63B 69/00* (2006.01)

(52) U.S. Cl. ..... 473/435; 273/396

(58) Field of Classification Search ..... 273/400, 273/396; 473/431, 434, 435, 446, 447, 478
See application file for complete search history.

(56) References Cited

U.S. PATENT DOCUMENTS 1,591,753 A * 7/1926 Flaugh ..... 473/421
2,819,901 A * 1/1958 Mateja ..... 473/421
4,036,494 A * 7/1977 Hayes ..... 473/481
4,072,295 A * 2/1978 Roberts ..... 256/26
4,693,472 A * 9/1987 Newman et al. ..... 473/435
5,054,791 A * 10/1991 Ball ..... 273/396
6,991,566 B1 * 1/2006 McKinney, Sr. ..... 473/459

* cited by examiner

*Primary Examiner*—Gene Kim
*Assistant Examiner*—M Chambers
(74) *Attorney, Agent, or Firm*—Larson & Larson; Frank Liebenow

(57) ABSTRACT

The shield device shown herein is one to aid in soccer practice. An individual player can practice kicking a soccer ball into the apparatus and have it bounced back in his or her general area. The lower area of the shield comprises a back panel and two side panels connected at an angle to the back panel. Each panel is made of a sufficiently rigid material, such as plywood, to absorb the impact of the kicked soccer ball. Above the panels is netting, such as nylon netting, to guard against and intercept errant flights of the ball.

11 Claims, 4 Drawing Sheets

BACKGROUND SHIELD FOR SOCCER PRACTICE

BACKGROUND OF THE INVENTION

1. Field of the Invention

This invention relates to a specifically designed background shield for soccer practice. More specifically this shield is designed to return the soccer ball back to the area from where the ball is kicked. Still more specifically, this background shield is related to a foldable and portable shield which may be transported and which is foldable for storage and for transportation.

2. State of the Prior Art

There are a number of patents describing various background shields for practicing various games. For example, U.S. Pat. Nos. 1,591,753 and 4,072,295 disclose foldable screens, backstops or batting cages in which a batter can swing at a thrown baseball without the danger of having the baseball hitting a catcher or a spectator. These are of primarily steel mesh or chain link fences.

U.S. Pat. No. 4,693,472 shows a portable background net made of nylon or other low extensible threads suitable for practicing tennis, cricket, baseball, etc.

U.S. Pat. No. 2,229,180 describes a game played against a vertical wall with an upper backwardly sloped section, which wall is apparently non-portable and against which a tennis ball, etc., is bounced against the wall. Each of the players has a catching device comprising a handle, a wire loop connected to the handle and an open-ended bag attached to the loop. One player bounces the ball to a designated area on the wall in a manner such that the bounced ball cannot be caught by an opposing player in his "bag".

U.S. Pat. No. 5,054,791 to Ball describes a shield device to aid in soccer practice and is hereby incorporated by reference. With this device, an individual player can practice kicking a soccer ball into the apparatus and have it bounced back in his or her general area. The lower area of the shield comprises a back panel and two side panels connected at an angle to the back panel. Each panel is made of a sufficiently rigid material, such as thick plywood, to absorb the impact of the kicked soccer ball. Above the panels there is netting, such as nylon netting to guard against and intercept errant flights of the ball. This patent was filed and is owned by the present inventor. Unfortunately, the support structure of the described device does not always keep the shield upright after being hit by a soccer ball.

What is needed is a soccer shield having good ball-return characteristics such as that of U.S. Pat. No. 5,054,791 but also having the ability to remain upright after being struck by a soccer ball.

OBJECTIVES

It is an object of this invention to provide a shield for soccer practice.

It is also an object of this invention to provide such a shield which will allow the ball to be bounced back toward the playing area.

It is also an object of this invention to provide an upper section of netting to protect against wild kicks.

It is also an object of this invention to provide such a shield which is preferably portable.

Other objects will become obvious upon reading the detailed description of the invention as given hereinafter.

SUMMARY OF THE INVENTION

In accordance with the present invention, a shield for soccer practice has been designed. This shield comprises a three-sided backdrop including a back panel and two side panels each connected to the back panel and positioned at angles of more than 90 degrees with respect to the back panel. Preferably these side panels are connected to the back panel by pivoting means such as hinges so that the said angles may be adjusted and so that the side panels may be closed flush with the back panel for storage and transportation. The back panel and each of the side panels are solid and of sufficient strength to withstand the impact of a kicked soccer ball. Above each said panel there is netting, preferably made from nylon or other strong fiber, which can contain errant kicks which elude the back panel. This netting is rigidly connected to the lower solid panels in such a manner that the impact of a soccer ball will not separate the netting. The netting is fastened to two outermost posts extending above the side panels and stretched tightly over but not fastened to two posts rising from the back panels. The posts, particularly the two posts to which the netting is attached should be removable from the supporting fixtures which are affixed to the side panels. Removal of the netting is advantageous when the three panels are to be folded for transportation or storage. The side panels have bracing supports on the backside thereof to keep the shield from being knocked backward by the impact of a kicked soccer ball. This brace means is preferably detachable for storage and transportation. In some embodiments, a pair of straps is provided for holding the posts, supports and netting during storage and transportation.

In one embodiment, a shield for soccer practice is disclosed including a back panel with a first and a second side opposite to each other, the back panel is made of a strong rigid material capable of withstanding the impact of a kicked soccer ball, the back panel is capable of being positioned in a vertical position with the first and second sides thereby extending vertically. The shield includes a first and second side panel of a similar rigid material, the first side panel being connected to the first side of the back panel by a hinge and the second side panel being connected to the second side of the back panel by another hinge. First and second posts extend vertically upward from a back of the back panel, the first post being is removably affixed to the back of the back panel and adjacent to the first side of the back panel and the second post is removably affixed to the back of the back panel and adjacent to the second side of the back panel, the first and second posts extending above the back panel. A third post extends vertically upward from and is removably affixed to the first side panel, the third post is spaced from and parallel to a side of the first side panel which is connected to the back panel, the third post extends above the first side panel. A fourth post extends vertically upward from and is removably affixed to the second side panel, the fourth post is spaced from and parallel to a side of the second side panel which is hingedly connected to the back panel, the fourth post extending above the second side panel. Netting of strong cord having reachs from the third post, behind the first and second posts and to the fourth post, the height of the netting is approximately a height of the posts, the netting being at least temporarily affixed to the third post and to the fourth post. A first and second support capable of maintaining the shield in upright position against the impact of a kicked soccer ball is provided, the first support is removably affixed to the first side panel and extends on an angle downward in a direction towards the back area of the shield, the second support is removably affixed to the second side panel and extends on the angle downward in the direction towards the back area of the shield.

In another embodiment, a shield for practicing soccer is disclosed including a back panel that has a left and a right side opposite to each other, made of a strong rigid material capable of withstanding the impact of a kicked soccer ball, the back panel is capable of being positioned in a vertical position with the left and right sides extending vertically. The shield includes a left side panel of a similar rigid material and is hingedly connected to the left side of the back panel. The shield also includes a right side panel of a similar rigid material and is hingedly connected to the right side of the back panel. Left and right post extend vertically upward from the back of the back panel, the left post is removably affixed to the back panel and adjacent to the left side of the back panel and the right post is removably affixed to the back panel and adjacent to the right side of the back panel, the left and right posts extending above said back panel approximately the width of netting that captures stray soccer balls. A left side post extends vertically upward from and is removably affixed to the left side of the left side panel and a right side post extends vertically upward from and is removably affixed to the right side of the right side panel. A left and right support maintains the shield in an upright position against the impact of a kicked soccer ball, the left support removably affixed to the left side panel and extends on an angle downward in a direction towards the back area of the shield, the right is support removably affixed to the right side panel and extends on an angle downward in the direction towards the back area of the shield. The netting is made from a strong cord having a sufficient length to reach from the left side post, behind the left and right posts and to the right side post, the netting is at least temporarily affixed to the third post and to the fourth post.

In another embodiment, method for practicing soccer is disclosed including providing a shield for soccer practice, the shield has a back panel that has a left and a right side opposite to each other, made of a strong rigid material capable of withstanding the impact of a kicked soccer ball, the back panel is capable of being positioned in a vertical position with the left and right sides extending vertically. The shield includes a left side panel of a similar rigid material and is hingedly connected to the left side of the back panel. The shield also includes a right side panel of a similar rigid material and is hingedly connected to the right side of the back panel. Left and right post extend vertically upward from the back of the back panel, the left post is removably affixed to the back panel and adjacent to the left side of the back panel and the right post is removably affixed to the back panel and adjacent to the right side of the back panel, the left and right posts extending above said back panel approximately the width of netting that captures stray soccer balls. A left side post extends vertically upward from and is removably affixed to the left side of the left side panel and a right side post extends vertically upward from and is removably affixed to the right side of the right side panel. A left and right support maintains the shield in an upright position against the impact of a kicked soccer ball, the left support removably affixed to the left side panel and extends on an angle downward in a direction towards the back area of the shield, the right is support removably affixed to the right side panel and extends on an angle downward in the direction towards the back area of the shield. The netting is made from a strong cord having a sufficient length to reach from the left side post, behind the left and right posts and to the right side post, the netting is at least temporarily affixed to the third post and to the fourth post. The method continues with kicking a soccer ball at the shield, whereas the shield deflects the soccer ball and then playing the soccer ball after the soccer ball returns from the shield.

BRIEF DESCRIPTION OF THE DRAWINGS

The description of the invention is facilitated by reference to the drawings.

DESCRIPTION OF THE PREFERRED EMBODIMENTS

Figure 1:
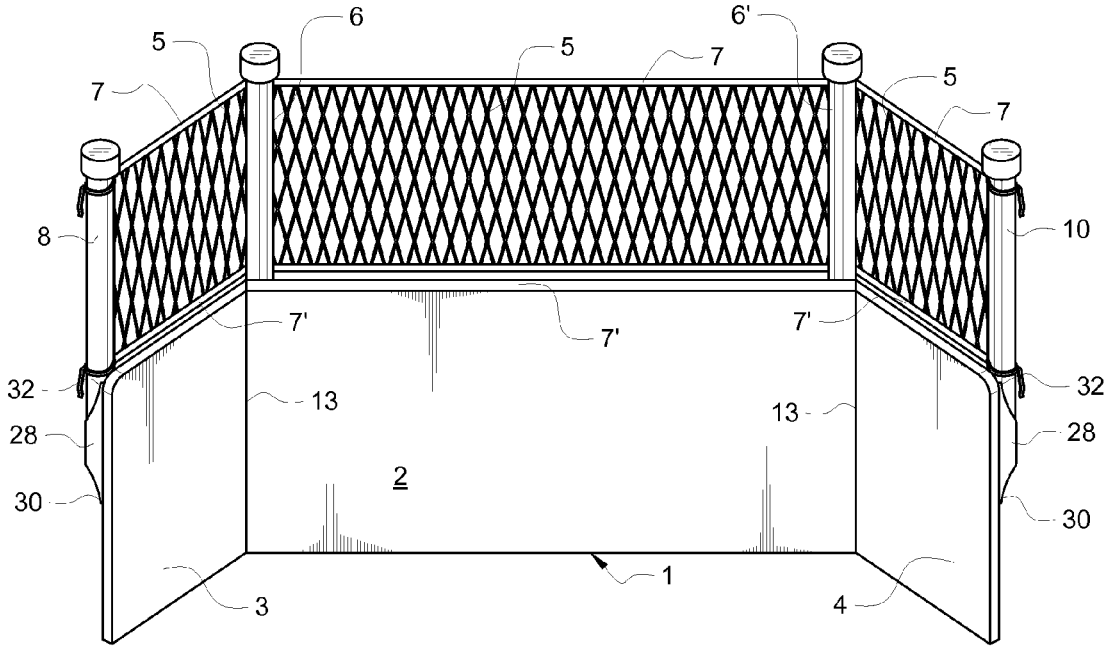
FIG. 1 is an elevational front view of a preferred embodiment of the present invention.

In the preferred embodiment shown in FIG. 1, background shield 1 comprises back panel 2 and side panels 3 and 4. Netting 5 has upper edging 7 and lower edging 7' and is fastened to posts 8 and 10. Posts 8 and 10 have lower portions (not shown) which fit into openings in sleeves 28 and are supported by the sleeves 28. Netting 5 is stretched around middle posts 6/6' but is preferably not fastened to these two middle posts 6/6'. When it is desired to move or store the shield, the posts 8/10 are lifted off of sleeves 28 so that the netting may be folded and the side panels 3/4 folded onto the back panel 2.

Figure 2:
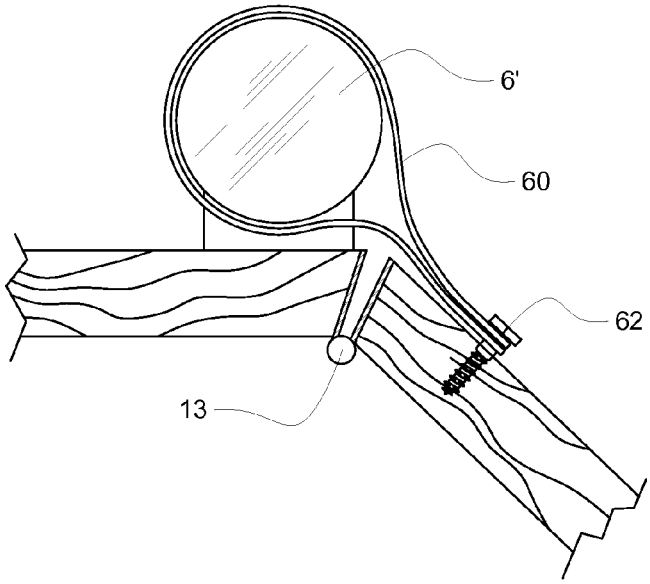
FIG. 2 is a top plan view of the juncture of two sections of the embodiment of the present invention shown in FIG. 1.

FIG. 2 shows a hinge 13 by which the right panel 4 is pivotally connected to the back panel 2. A loop 60 is fastened to the right side panel 4. When the post 6' is inserted into its sleeve 28, it captures the loop 60, thereby restricting the movement of the right side panel 4 so, when hit by a soccer ball, it doesn't open wide than desired. It is preferred to hold the side panel 4 in a 120 degree relationship to the back wall 2. Similar provisions are made with regard to the positioning of the left side panel 3 with respect to the back panel 2.

Figure 3:
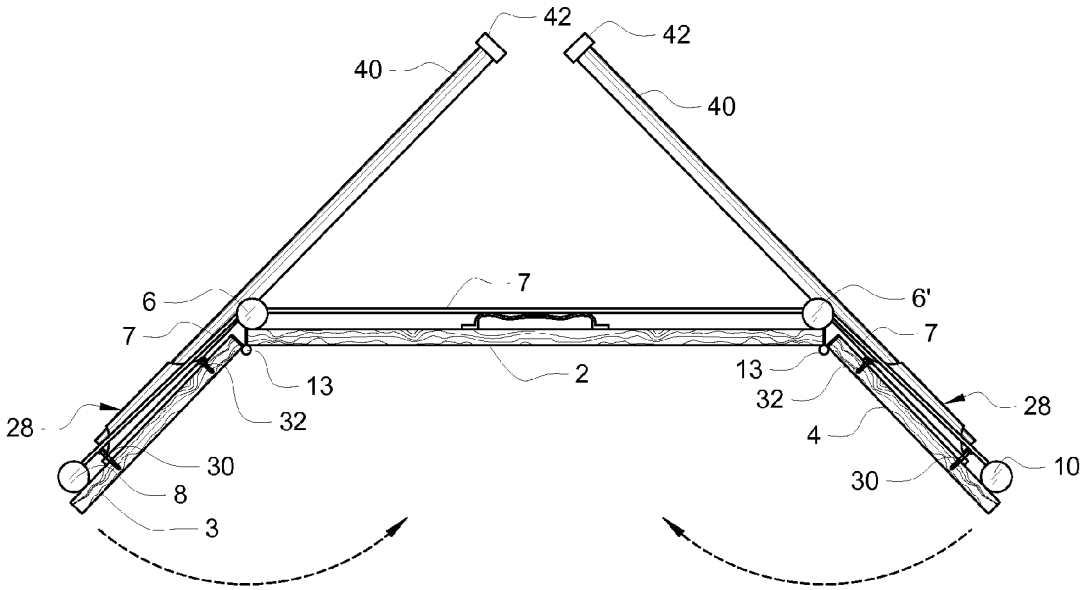
FIG. 3 is a top plan view of the preferred embodiment of the present invention.
Figure 6:
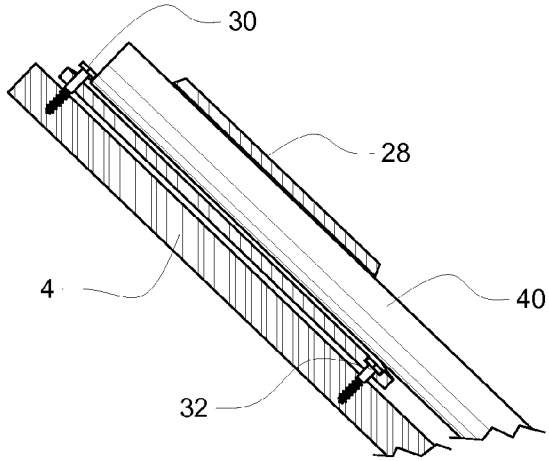
FIG. 6 is a detail view of the sleeve for holding posts of the preferred embodiment of the present invention.

The top plan view of FIG. 3 shows angular bracing supports 40 with side panel sleeves 28. The supports 40 are held in place by the side panel sleeves 28, maintaining the upright position of the shield 1. The sleeves 28 are fastened to the side panels 3/4 with screws 30/32. The back most screw 32 is countersunk so as to not interfere with the insertion of the supports 40. The front most screw 30 is a screw with a head such as a pan-head screw and blocks the supports 40 from passing out of their end of the sleeves 28. Details of the sleeves 28 are shown in FIG. 6.

Figure 4:
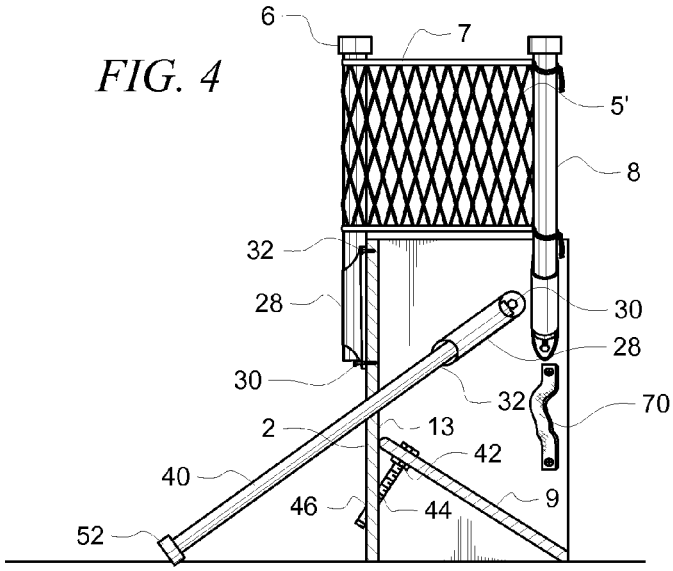
FIG. 4 is a cross-sectional side elevational view of the preferred embodiment of the present invention.

The partial cross-sectional view of FIG. 4 shows another view of the bracing structure described above for FIG. 3. The supports 40 are held in an angular position by sleeves 28. The sleeves 28 have screws 30/32 as shown in FIG. 3, the countersunk screw 32 positioned in the upper end of the sleeves 28. In some embodiments, a rubber cap 52 is affixed to the end of the supports 40 to reduce slippage on paved surfaces. FIG. 4 also shows in cross-section an optional device, namely, deflector panel 9 which will intercept a ball directed toward the lowest area of panel 2 and redirect it to a higher region of panel 2. This will mean that the ball is bounced back in the air instead on the adjacent ground area. The deflector panel 9 is removably held in place by a bolt 44 that is secured to the deflector panel 9 by a nut 42 and passes through a hole 46 in the back panel 2. This figure also shows how the sleeves 28 are abutted to and rigidly affixed to the back panel 2 for support of posts 6/6'. Similar arrangements apply for connectors 28 which receive and support posts 8 and 10 (posts 6 and 8 are visible on the side which is shown).

Figure 5:
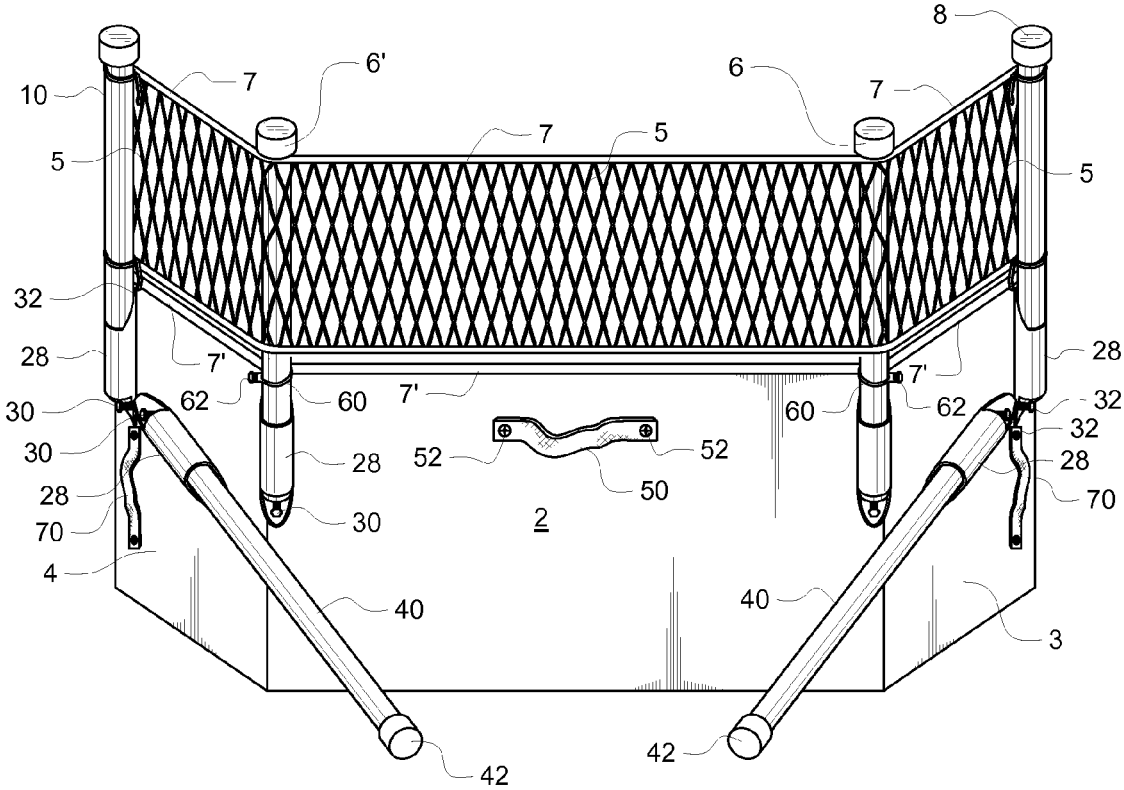
FIG. 5 is an elevational rear view of a preferred embodiment of the present invention.

A rear elevational view of the preferred embodiment is shown in FIG. 5. The shield 1 comprises back panel 2 and side panels 3 and 4. Netting 5 has upper edging 7 and lower edging 7' and is fastened to posts 8 and 10. Posts 8 and 10 have lower portions which fit into sleeves 28 and are supported by the sleeves 28. Netting 5 is stretched around middle posts 6/6' but is preferably not fastened to these two middle posts 6/6'. The supports 40 are shown with the optional rubber caps 42, fitting into sleeves 28 on the side panels 3/4.

When it is desired to move or store the shield, the posts 8/10 are lifted off of sleeves 28 so that the netting may be folded and the side panels 3/4 folded onto the back panel 2. In some embodiments, carrying straps 28 are provided for carrying the posts and netting after the side panels 3/4 are folded against the back panel 2. In some embodiments, a handle 50 is provided, fastened by screws 52. The handle can be any handle known in the industry including handles made from cloth webbing, leather or metal.

A cutaway view of the sleeve for holding posts of the preferred embodiment of the present invention is shown in FIG. 6. The sleeve 28 is preferably cut at an angle at each end providing enhanced insertion ease for the posts 6/6'/10/12 and supports 40 as well as improving ease of assembly by exposing screws 30/32. It can be seen that the back or upper screw 32 is countersunk to allow the posts 6/6'/10/12 and supports 40 to pass and enter the sleeve 28 while the front or lower screw 30 is not countersunk and its head blocks passage of the posts 6/6'/10/12 and supports 40 so they don't exit that end of the sleeve. It is recognized that other sleeve 28 configurations are possible without veering from the present invention. For example, a sleeve 28 is cut at right angles (not shown) and a hole is drilled near each end allowing a screw and screwdriver to pass through into another hole on the opposite side for fastening the sleeve 28 to the panels 2/3/4.

Figure 7:
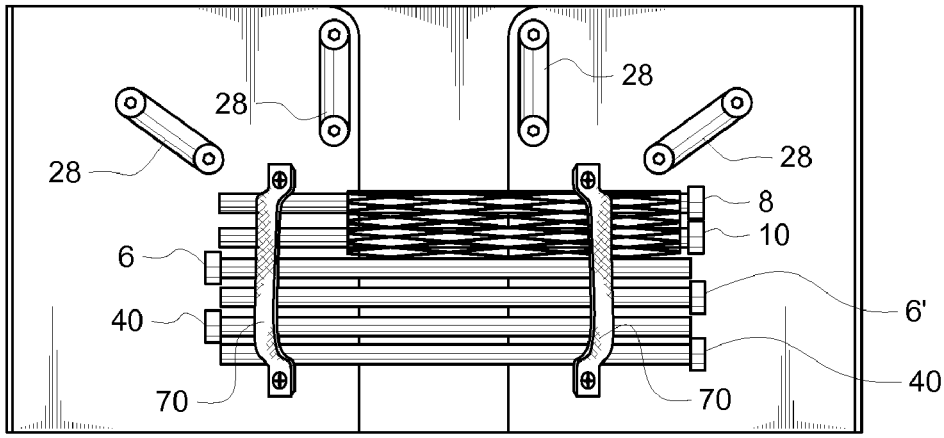
FIG. 7 is an elevational rear view of a preferred embodiment of the present invention in a closed configuration.

A rear view of the shield of the preferred embodiment of the present invention is shown in FIG. 7. The sleeves 28 for holding the back posts 6/6' and the supports 40 are shown. The posts 8/10, posts 6/6' and supports 40 are shown held by straps 70. For convenience, the netting 5 is wrapped around either or (preferably) both end posts 8/10.

While plywood has been indicated as suitable for use in the panels 2/3/4 of the above device, other suitable materials may be used such as sheeting of wood, plastic, metal, etc., provided the material can withstand the impact shock of a kicked soccer ball. Moreover, other types of netting may be used in place of the nylon netting such as cotton cord, metal wire, etc., provided it has the strength to serve this purpose. Any tubing can be used for the supports 40 and posts 6/6'/10/12. Although round tubing is preferred, any shape can be used including square, rectangular, hexagonal, etc. It is preferred that the tubing be a standard PVC tubing which is sturdy, relatively light weight and low cost. For manufacturing simplicity, the posts 6/6'/10/12 and supports 40 can be made from the same stock and be the same size, though this is not necessary. The sleeves 28 are made from tubing of the same shape as the supports 40 and posts 6/6'/10/12. The inner diameter of the sleeves 40 is preferably slightly larger than the outer diameter of the posts 6/6'/10/12 to assure a tight fit. The sleeves 40 can be made of the same material as the posts 6/6'/10/12 or can be made from other materials such as aluminum.

The dimensions of the panels and the netting can be varied to convenient sizes. A practical size for portability is 2 feet high and 4 feet wide for the back panel and 2 feet by 2 feet for the side panels. The relatively small size of the back panel also allows the player to practice accuracy in his kicking. The netting may be 1-3 feet high, preferably 1.5-2 feet, and long enough to reach from the third post to the fourth post as described herein with any additional amount needed for fastening.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A shield for soccer practice comprising:

a back panel having a first and a second side opposite to each other, the back panel being of a strong rigid material capable of withstanding the impact of a kicked soccer ball, the back panel being capable of being positioned in a vertical position with the first and second sides thereby being extended vertically;

a first and second side panel of a similar rigid material, the first side panel being hingedly connected to the first side of the back panel and the second side panel being hingedly connected to the second side of the back panel;

a first and second posts extending vertically upward from a back of the back panel, the first post being removably affixed to the back of the back panel and adjacent to the first side of the back panel and the second post being removably affixed to the back of the back panel and adjacent to the second side of the back panel, the first and second posts extending above the back panel;

a third post extending vertically upward from and removably affixed to the first side panel, the third post spaced from and parallel to a side of the first side panel which is hingedly connected to the back panel, the third post extending above the first side panel;

a fourth post extending vertically upward from and removably affixed to the second side panel, the fourth post spaced from and parallel to a side of the second side panel which is hingedly connected to the back panel, the fourth post extending above the second side panel;

a netting of strong cord having a sufficient length to reach from the third post, behind the first and second posts and to the fourth post, a height of the netting being sufficient to reach from an upper edge of the first side panel to a top of the posts, the netting being at least temporarily affixed to the third post and to the fourth post; and a first and second support capable of maintaining the shield in upright position against the impact of a kicked soccer ball, the first support removably affixed to the first side panel and extending on an angle downward in a direction towards a back area of the shield, the second support removably affixed to the second side panel and extending on the angle downward in the direction towards the back area of the shield, said shield further comprising a first loop affixed to the first side panel such that the first loop can be placed around the first post when the first post is installed, thereby holding the first side panel in an open position; and further comprising a second loop affixed to the second side panel such that the second loop can be placed around the second post when the second post is installed, thereby holding the second side panel in an open position.

2. The shield of claim 1, further comprising a handle attached to the back panel.

3. The shield of claim 1, further comprising at least two straps, at least one of the straps affixed to the first side panel and a second one of the straps affixed to the second side panel, the straps vertically oriented so that the posts and the supports can be held by the straps during storage and transportation of the shield.

4. The shield of claim 1, further comprising a deflector means reaching from the ground in front of the back panel and affixed to the back panel at a location higher than the ground whereby a soccer ball hitting the deflector means will be directed upwardly.

5. The shield of claim 4, whereas the deflector means is affixed to the back panel with at least two bolts, the bolts affixed to the deflector means by nuts, the bolts interfacing the deflector means at the location higher than the ground by passing through holes in the back panel.

6. The shield of claim 1, wherein the first side panel is connected to the first side of the back panel by a first hinge and the second side panel is connected to the second side of the back panel by a second hinge.

7. A shield for soccer practice comprising:

a back panel having a left side and a right side opposite to each other, the back panel being of a strong rigid material capable of withstanding the impact of a kicked soccer ball, the back panel being capable of being positioned in a vertical position with the left and right sides thereby extended vertically;

a left side panel of a similar rigid material, the left side panel hingedly connected to the left side of the back panel, the left side panel having a left side;

a right side panel of a similar rigid material, the right side panel hingedly connected to the right side of the back panel, the right side panel having a right side;

a left and right post extending vertically upward from the back of the back panel, the left post being removably affixed to the back panel and adjacent to the left side of the back panel and the right post being removably affixed to the back panel and adjacent to the right side of the back panel, the left and right posts extending above said back panel approximately the width of a netting;

a left side post extending vertically upward from and removably affixed to the left side of the left side panel, the left side post extending above the first side panel;

a right side post extending vertically upward from and removably affixed to the right side of the right side panel, the right side post extending above the first side panel; and a left and right support capable of maintaining the shield in upright position against the impact of a kicked soccer ball, the left support removably affixed to the left side panel and extending on an angle downward in a direction towards a back area of the shield, the right support removably affixed to the right side panel and extending on the angle downward in the direction towards the back area of the shield;

whereas the netting is made from a strong cord having a sufficient length to reach from the left side post, behind the left and right posts and to the right side post, the netting being at least temporarily affixed to the third post and to the fourth post wherein said shield further comprising a left loop means affixed to the left side panel such that the left loop means can be placed around the left post when the left post is installed, thereby holding the left side panel in an open position; and further comprising a right loop means affixed to the right side panel such that the right loop means can be placed around the right post when the right post is installed, thereby holding the right side panel in an open position.

8. The shield of claim 7, further comprising a handle means attached to the back panel.

9. The shield of claim 7, further comprising at least two strap means, at least one of the strap means affixed to the left side panel and a second one of the strap means affixed to the right side panel, the straps vertically oriented so that the posts and the supports can be held by the straps during storage and transportation of the shield.

10. The shield of claim 7, further comprising a deflector means reaching from the ground in front of the back panel and affixed to the back panel at a location higher than the ground whereby a soccer ball hitting the deflector means will be directed upwardly.

11. The shield of claim 10, whereas the deflector means is affixed to the back panel with at least two bolts, the bolts affixed to the deflector means by nuts, the bolts interfacing the deflector means at the location higher than the ground by passing through holes in the back panel.

* * * * *